US008678108B1

(12) United States Patent
Eriksen

(10) Patent No.: US 8,678,108 B1
(45) Date of Patent: Mar. 25, 2014

(54) TORQUE TRANSMITTING ELASTOMERIC ELEMENT IN CASING DRILLING DRILL LOCK ASSEMBLY

(75) Inventor: Erik P. Eriksen, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 484 days.

(21) Appl. No.: 12/893,923

(22) Filed: Sep. 29, 2010

Related U.S. Application Data

(60) Provisional application No. 61/246,758, filed on Sep. 29, 2009.

(51) Int. Cl.
*E21B 7/20* (2006.01)

(52) U.S. Cl.
USPC ..... 175/57; 175/171; 175/261

(58) Field of Classification Search
USPC ..... 175/57, 171, 232, 260, 261, 317
See application file for complete search history.

(56) References Cited

U.S. PATENT DOCUMENTS 4,655,301 A * 4/1987 Verstraeten ..... 175/171
5,197,553 A 3/1993 Leturno
6,732,822 B2 5/2004 Slack
7,021,382 B2 4/2006 Angman
7,360,594 B2 * 4/2008 Giroux et al. ..... 166/242.6
2007/0051538 A1 * 3/2007 Angman et al. ..... 175/57
2007/0175665 A1 * 8/2007 Tessari et al. ..... 175/65

OTHER PUBLICATIONS

U.S. Appl. No. 12/275,396, filed Nov. 21, 2008.

* cited by examiner

*Primary Examiner* — William P Neuder
*Assistant Examiner* — Richard Alker
(74) *Attorney, Agent, or Firm* — Osha Liang LLP

(57) ABSTRACT

A casing drilling assembly includes a profile sub having an interior profile shoulder and secured a casing string. A bottom hole assembly is run into and retrievable from the casing string. Stop dogs carried by the bottom hole assembly lands on the profile shoulder and stop downward movement of the bottom hole assembly, positioning an underreamer below the casing string. A mandrel is coupled to the bottom hole assembly. An elastomeric sleeve encircles the mandrel below a setting ring. A running tool releasably couples to the mandrel and moves the setting ring downward relative to the mandrel to a lower position to deform the sleeve into frictional engagement with the casing string and the mandrel to transmit torque and axial load between the bottom hole assembly and the casing string.

15 Claims, 6 Drawing Sheets

TORQUE TRANSMITTING ELASTOMERIC ELEMENT IN CASING DRILLING DRILL LOCK ASSEMBLY

CROSS-REFERENCE TO RELATED APPLICATION

This application claims priority to provisional application U.S. 61/246,758 filed Sep. 29, 2009.

FIELD OF THE INVENTION

This invention relates in general to drilling a well with casing employed as the drill string, and in particular to a drill lock assembly that transmits torque from the casing to the drill bit with an elastomeric element.

BACKGROUND

One type of oil and gas well drilling involves drilling with a casing string rather than drill pipe. Typically, the operator rotates the casing string to cause rotation of a drill bit at the bottom of the casing string. In one technique, the drill bit is part of a retrievable bottom hole assembly. The bottom hole assembly has a drill lock assembly on its upper end that releasably locks the bottom hole assembly to the casing string to transmit torque as well as weight. The drill bit and an underreamer are mounted to the lower end of the bottom hole assembly. The bottom hole assembly may be retrieved and re-run for repair. The bottom hole assembly is also retrieved at the total depth for cementing the casing string in the well.

A profile sub with an internal annular recess and a set of splines is connected into the casing string near or at the bottom. The drill lock assembly has dogs that will engage the annular recess to transmit axial force. The drill lock assembly also has torque transfer members that move out into engagement with the splines to transfer torque.

A variety of drill lock assemblies are known. All require mechanisms to move the axial load and torque transfer members between locked and unlocked positions. While some of these assemblies are successful, reducing the complexity is desirable.

SUMMARY

The drill lock portion of the bottom hole assembly has a mandrel coupled to the upper portion of the bottom hole assembly. An elastomeric sleeve encircles the mandrel. A setting mechanism moves the sleeve relative to the mandrel from an unset position to an set position in frictional engagement with the casing string and the mandrel to transmit torque and axial load between the bottom hole assembly and the casing string.

In the embodiment shown, the sleeve has a greater thickness and shorter length while in the set position than when in the unset position. The setting mechanism has a retainer that selectively holds the sleeve in the set position. A release device is in cooperative engagement with the sleeve and the mandrel. The release device will selectively allow the sleeve to move from the set position back to the unset position. The release device may operate in response to the landing of a sealing object pumped from a drilling rig down to the release device.

The setting mechanism includes a setting ring encircling the mandrel above the sleeve, the setting sleeve having an upward facing shoulder. A running tool that releasably secures to the mandrel in engagement with the shoulder on the setting ring and moves the setting ring downward relative to the mandrel to move the sleeve to the set position. In the embodiment shown, the running tool moves the setting ring straight downward without rotation when moving the sleeve to the set position. In the example shown, the retainer comprises a ratchet ring that allows downward movement of the setting ring relative to the mandrel but prevents upward movement of the setting ring.

A profile sub secures into the casing string and has an annular upward facing profile shoulder. Spring-biased stop dogs carried by the mandrel slide down the casing string and land on the profile shoulder to stop further downward movement of the bottom hole assembly.

DETAILED DESCRIPTION OF THE INVENTION

Figure 1:
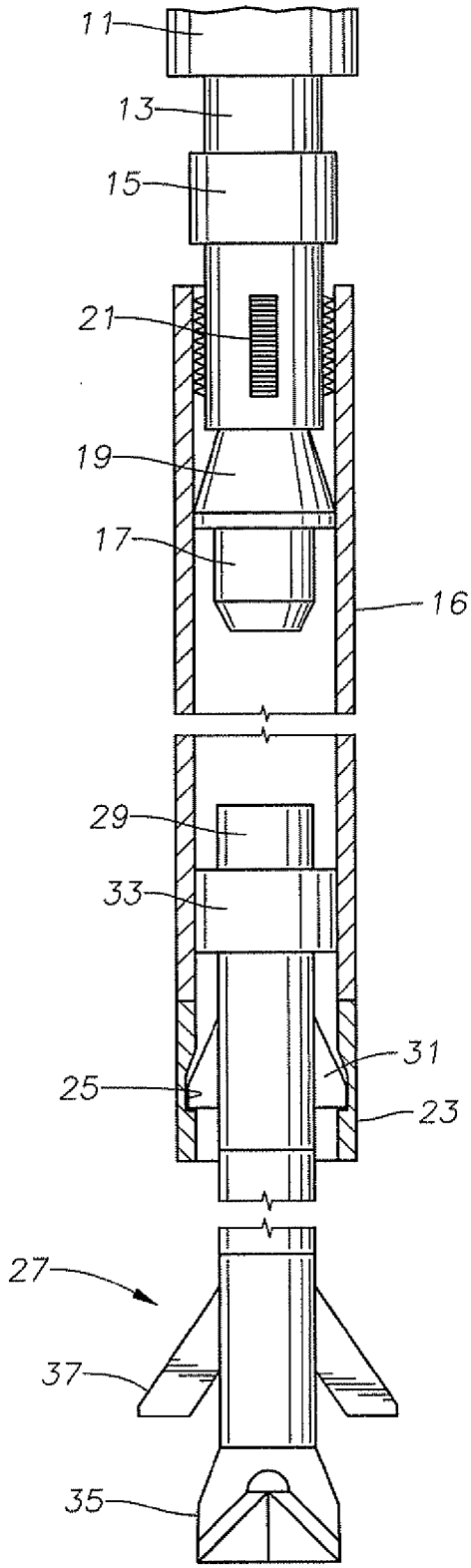
FIG. 1 is a schematic sectional view illustrating a casing drilling system in accordance with this invention.

Referring to FIG. 1, a top drive 11 of a drilling rig is schematically shown. Top drive 11 moves up and down a derrick during drilling and casing running operations. Top drive 11 has a drive shaft or quill 13 that it rotates. A casing gripper 15 secures to quill 13 for supporting and rotating a string of casing 16. The word "casing" as used herein also refers to other tubulars that are cemented in a wellbore to line a wellbore, such as a liner string. Casing gripper 15 has a spear 17 that extends into the inner diameter of the upper portion of casing string 16. Spear 17 has a seal 19 that seals against the inner diameter of casing string 16. In this embodiment, gripping members 21 are mounted on spear 17 and are moved radially outward by casing gripper 15 into gripping engagement with the inner diameter of casing string 16. Alternately, casing gripper 15 could have external grippers (not shown) that move radially inward to grip the outer diameter of casing string 16.

Casing string 16 includes a profile sub 23 at or near its lower end. Profile sub 23 is a tubular member having an annular groove 25, defining an upward-facing profile shoulder within the interior of casing string 16. A bottom hole assembly (BHA) 27 includes a drill lock assembly 29 that has a plurality of stop dogs 31 that land on the shoulder of groove 25, preventing further downward movement of bottom hole assembly 27.

Drill lock assembly 29 also has an elastomeric element 33, which may be similar to an elastomeric element of a conventional casing packer. Elastomeric element 33, when set, prevents axial movement of bottom hole assembly 27. Also, elastomeric element 33 transmits drilling torque from casing string 16 to bottom hole assembly 27. Elastomeric element 33 comprises a sleeve of elastomeric material. It may have a smooth inner diameter or it may have axially extending splines or ribs in its interior to facilitate transmitting torque. The exterior of elastomeric element 33 may be smooth and cylindrical. Elastomeric element 33 may have a composite design incorporating friction enhancing material, such as sand, pumice or metallic elements. In addition, carbon fibers and/or wire mesh may be added as reinforcing material to increase the mechanical strength of elastomeric element 33. Various elastomeric materials may be selected in order to tailor elastomeric element 33 to specific environments.

FIG. 1 shows elastomeric element 33 in an energized or set position in sealing and gripping engagement with the inner diameter of profile sub 23 of casing string 16. Drill lock assembly 29 is a setting mechanism that moves elastomeric element 33 from an unset run-in position to the set or energized position and back to an unset retrieval position.

BHA 27 has drilling tools including a drill bit 35 on its lower end. Another drilling tool comprises an underreamer 37, which is located above drill bit 35 for enlarging the pilot hole formed by drill bit 35. The arms of underreamer 37 are retractable for installation and retrieval of BHA 27. BHA 27 may include other components, such as a mud motor, which rotates drill bit 35 and underreamer 37 independently of casing string 16. Also, BHA 27 may include well bore logging tools and steering tools for directional drilling operations.

Figure 2A:
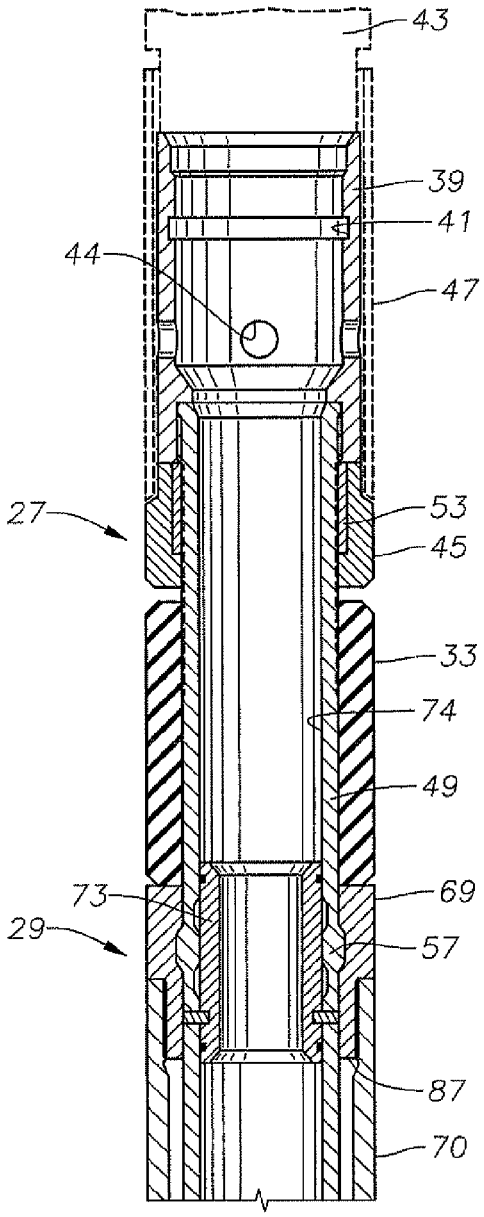
FIGS. 2A and 2B comprise a vertical sectional view of a drill lock assembly employed with the system in FIG. 1, shown in a run-in position.

Referring to FIG. 2A, drill lock assembly 29 has a latch sub 39 on its upper end. Latch sub 39 is a tubular member with a grooved profile 41 in its inner diameter for engagement by a setting or running tool 43. Latch sub 39 may also have one or more circulation ports 44 extending through its side wall to circulate fluid from the drilling rig. The setting mechanism includes a setting ring 45 located directly below and in contact with a lower end of latch sub 39 during the run-in position. Setting tool 43 has a setting sleeve 47 that extends over the outer diameter of latch sub 39 and engages an upward-facing shoulder on setting ring 45. Setting tool 43 may be of various types for moving setting sleeve 47 and setting ring 45 downward relative to latch sub 39. For example, setting tool 43 may be lowered on a cable and operated by electrical power sent through a conductor in the cable. Alternately, setting tool 43 could be located on the lower end of a string of drill pipe and actuated by applying drilling fluid pressure to the interior of the drill pipe string or by applying weight from the drill pipe. Setting tool 43 could also be operated on a cable or wire line that has a conductor to supply power to ignite a pyrotechnic device. When ignited, the pyrotechnic device creates high pressure to move setting sleeve 47 downward. These various types of setting tools are utilized conventionally for setting packers and bridge plugs in casing.

Figure 3:
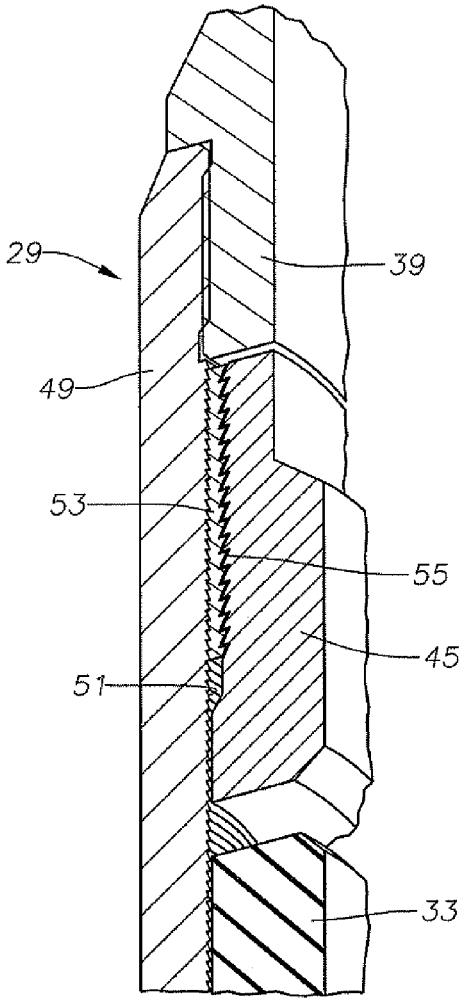
FIG. 3 is a perspective, sectional view of the elastomer setting portion of the drill lock assembly of FIGS. 2A and 2B.

A mandrel 49 has threads on its upper end that secure to internal threads in the inner diameter of latch sub 39. Latch sub 39 could be integrally formed with mandrel 49 and is considered to be a part of mandrel 49. Referring to FIG. 3, mandrel 49 has a set of small parallel grooves, referred to as wickers 51, extending downward from its upper end. Wickers 51 are preferably parallel to each other and located in planes perpendicular to the axis of mandrel 49. However, they could comprise threads. A retainer or lock ring 53 has mating wickers on its inner diameter that engage wickers 51. Lock ring 53 has sawtooth-shaped ratchet grooves 55 on its outer diameter that are larger in depth and axial length than wickers 51 in this embodiment. Ratchet grooves 55 engage with mating grooves in the inner diameter of setting ring 45. Ratchet grooves 55 are also preferably parallel to each other and located in planes perpendicular to the axis of mandrel 49. However, they could be threads in the alternative. Wickers 51 and grooves 55 enable a ratcheting action to occur as setting ring 45 moves downward. Lock ring 53 may be split or have serpentine slots to facilitate radial inward and outward expansion and contraction during this ratcheting movement. The inclination of ratchet grooves 55 is radially outward in an upward direction. Consequently, downward movement of lock ring 53 and setting ring 45 occurs, but lock ring 53 serves as a retainer to prevent upward movement of setting ring 45 on mandrel 49.

Figure 5:
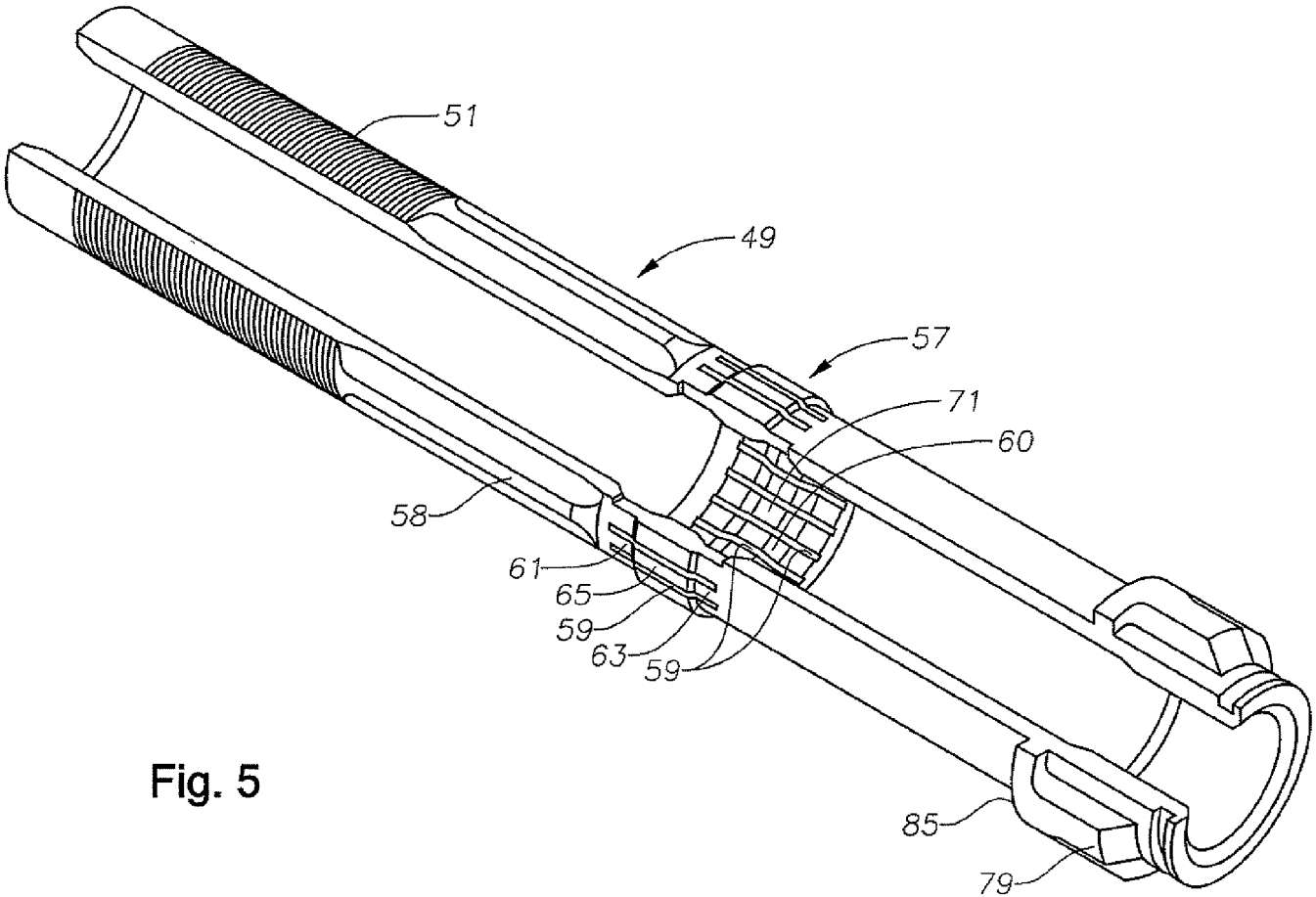
FIG. 5 is a perspective, sectional view of a mandrel of the drill lock assembly of FIGS. 2A and 2B.
Figure 6:
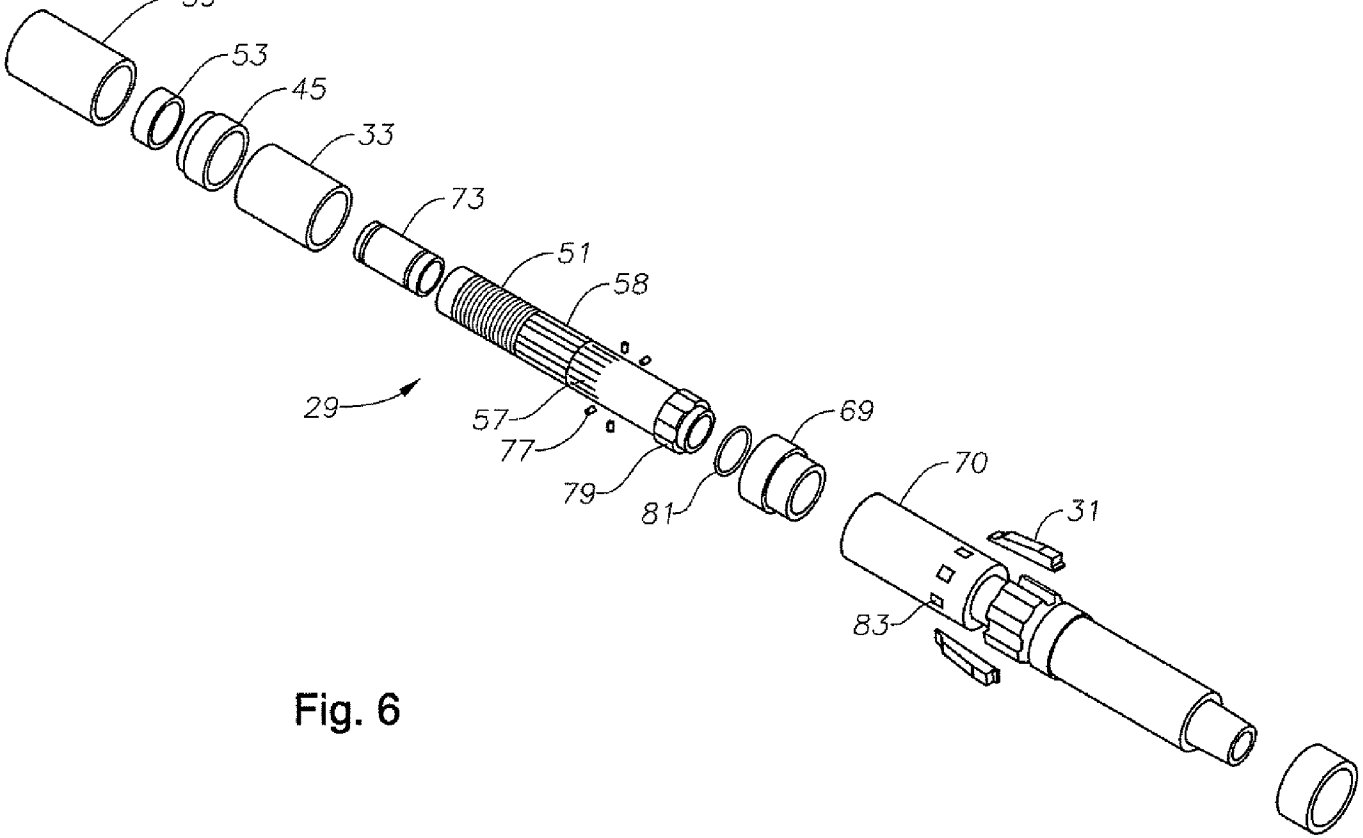
FIG. 6 is an exploded perspective view of the drill lock assembly of FIGS. 2A and 2B.

Briefly referring to FIG. 2A again, mandrel 49 has a release mechanism that includes a collet lock 57 below the set of wickers 51. Referring now to FIG. 5, mandrel 49 may also have a set of axially extending ribs 58 located above collet lock 57 and below wickers 51. In this example, axial ribs 58 have about the same length as the set of wickers 51. Axial ribs 58 are located on the outer diameter of mandrel 49 and are separated by axially extending recesses. Elastomeric element 33 (FIG. 6) has mating grooves and splines in its interior for engaging axial ribs 58.

Figure 4:
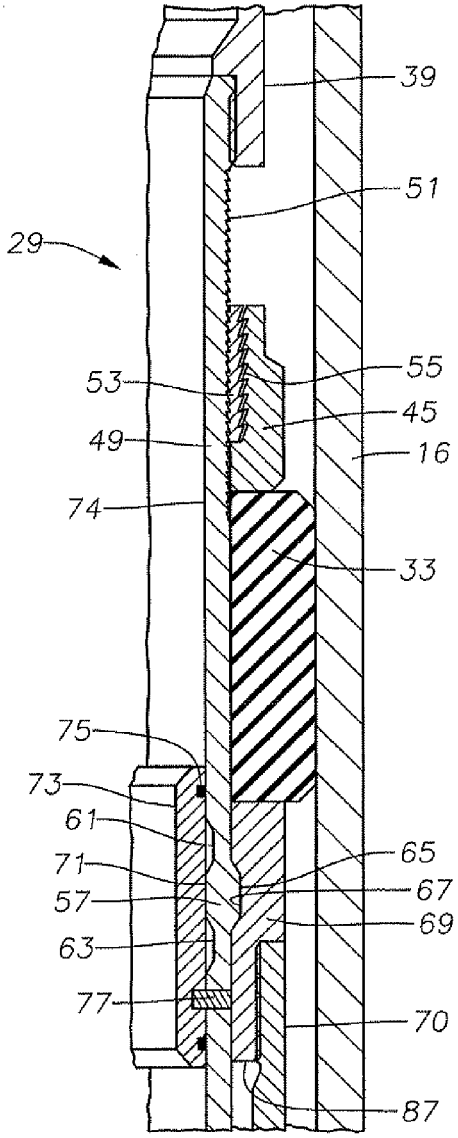
FIG. 4 is an enlarged sectional view of the elastomer setting portion of the drill lock assembly of FIGS. 2A and 2B, shown in a set position.

Collet lock 57 is a short section of mandrel 49 that has a plurality of axially extending slots 59 spaced circumferentially around mandrel 49. Slots 59 extend completely through the side wall of mandrel 49 to enable radial flexing of fingers 60 created by each slot 59. Fingers 60 have reduced thickness sections 61 at their upward ends and reduced thickness sections 63 at the lower ends. As shown in FIG. 4, reduced thickness sections 61 and 63 define outer protrusions 65 on collet lock 57 for engaging an annular recess or profile 67 within a connector sleeve 69. Connector sleeve 69 is secured by threads to a tubular bottom sub 70.

Collet lock 57 also has inner protrusions 71 between reduced thickness sections 61 and 63 that protrude radially inward. Inner protrusions 71 are engaged during the run-in and set positions by a release sleeve 73. Release sleeve 73 mounts within mandrel inner diameter 74. Release sleeve 73 has an outer diameter with seals 75 that seal to mandrel inner diameter 74 above and below collet lock 57 to prevent fluid flowing down mandrel inner diameter 74 from passing outward through collet lock 57. During the run-in and set positions, shear pins 77 secure release sleeve 73 rigidly to mandrel 49 in the position shown in FIG. 4. Subsequently, dropping or pumping down a sealing object, such as a dart or ball, from the surface results in the sealing object landing on the upper end of release sleeve 73. Applying greater fluid pressure to mandrel inner diameter 74 causes shear pin 77 to shear and release sleeve 73 to move downward out of engagement with inner protrusion 71.

Figure 2B:
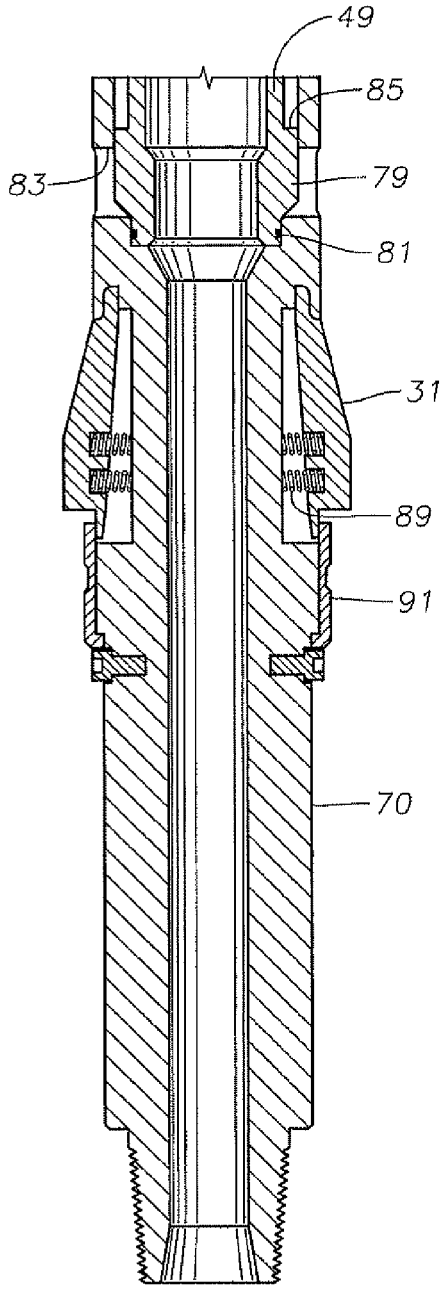
Figure 7A:
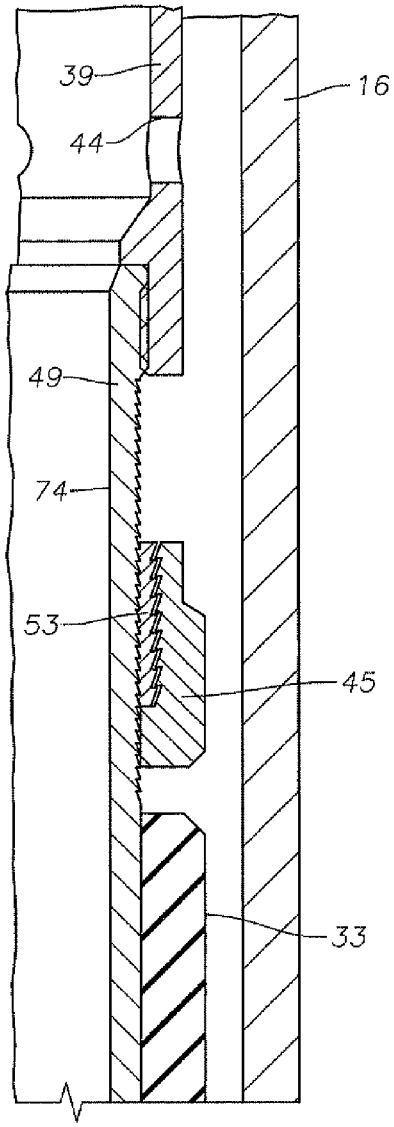
FIGS. 7A and 7B comprise a sectional view of the upper portion of the drill lock assembly of FIGS. 2A and 2B, shown in a retrieval position.
Figure 7B:
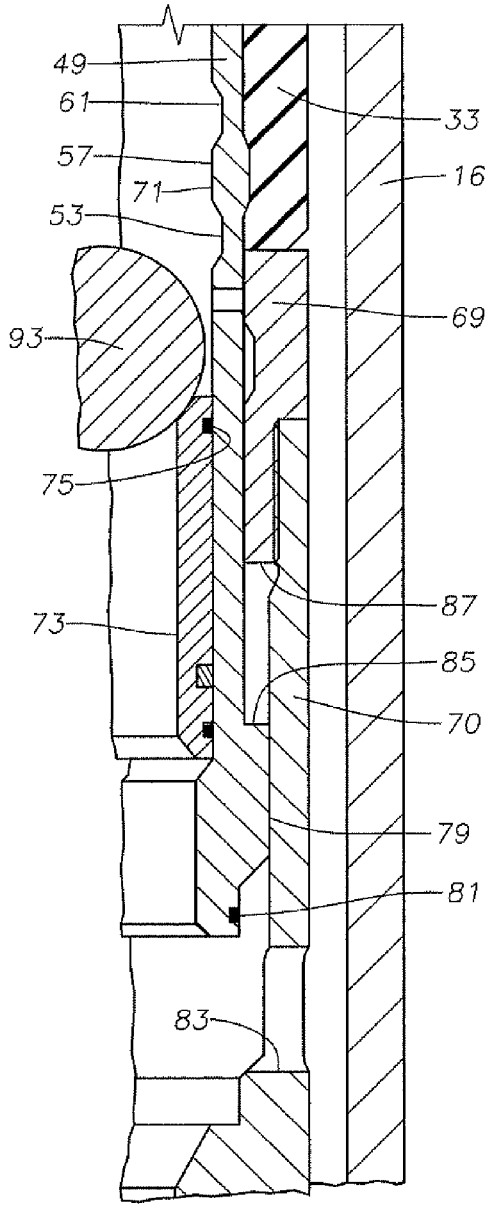

Referring to FIG. 2B, mandrel 49 has a set of lugs 79 formed at its lower end. Lugs 79 extend radially outward and engage axially extending shoulders in apertures 83 formed in bottom sub 70. A seal 81 on a lower end of mandrel 49 seals against the inner diameter of bottom sub 70 below apertures 83. Apertures 83 extend through the side wall of bottom sub 70. Lugs 79 are not radially flexible and serve to transmit torque to bottom sub 70. Lugs 79 also have upward-facing shoulders 85 upon the exterior. Shoulders 85 will engage a downward-facing shoulder 87 shown in FIG. 7B during retrieval. Downward-facing shoulder 87 comprises the lower end of connector sleeve 69. Mandrel 49 is coupled to BHA 27 by bottom sub 70, which has threads on its lower end that connect to BHA 27.

Referring to FIG. 2B, stop dogs 31 pivotally mount within recesses formed in the exterior of lower sub 70. Stop dogs 31 pivot outward about a pivot point at the upper end of each stop dog 31. Springs 89 bias the lower ends of stop dogs 31 outward. Retainer 91 encircles the exterior of bottom sub 70 at the lower end of each stop dog 31 to retain stop dogs 31 with bottom sub 70. During run-in, stop dogs 31 land on groove 25 (FIG. 1) to prevent further downward movement of drill lock assembly 29.

In operation, profile sub 23 will be assembled into the string of casing 16. The operator conveys BHA 27 down casing string 16. Stop dogs 31 slide along the inner diameter of casing string 16, then engage groove 25 to prevent further downward movement. The operator may use drill pipe, wire line or may pump down drilling fluid to convey BHA 27 to the lower end of casing string 16. Referring to FIG. 2A, setting tool 43 may be conveyed down with BHA 27, or it may be lowered into engagement subsequently on a wire line or drill pipe. The operator actuates setting tool 43 to move setting sleeve 47 downward. That results in setting ring 45 moving downward relative to mandrel 49, which deforms elastomeric element 33 outward into tight engagement with profile sub 23 and inward into tight engagement with mandrel 49. Setting ring 45 moves straight downward without rotation with setting sleeve 47, but cannot move upward because of its lock ring 53. FIG. 4 illustrates elastomeric element 33 in the set position. The operator may then retrieve setting tool 41

Referring again to FIG. 1, the operator connects casing gripper 15 to top drive quill 13. The operator actuates gripping members 21 to grip casing string 16. The operator rotates quill 13, which transmits rotation down through casing string 16 and elastomeric element 33 to drill bit 35. The operator also pumps drilling fluid down quill 13, spear 17 and through BHA 27. The drilling fluid exits nozzles in drill bit 35 and flows back up the annulus surrounding casing string 16. Downward weight of casing string 17 transfers from profile sub 23 through the energized elastomeric element 33 to BHA 27 and drill bit 35. Elastomeric sleeve 33 thus transmits downward force and torque.

When the operator desires to retrieve BHA 27, he drops a sealing element such as a ball 93 (FIG. 7B), which lands on release sleeve 73. The operator applies increased fluid pressure from the surface, which acts on ball 93 to exert a downward force on release sleeve 73. The downward force shears shear pin 77, causing release sleeve 73 to slide downward from the upper position shown in FIG. 4 to the lower position shown in FIG. 7B. When this occurs, release sleeve 73 no longer serves as a backup in engagement with collet lock 57.

Preferably, the operator connects a retrieval tool (not shown) similar to setting tool 43 to the lower end of a string of drill pipe. Alternatively, the operator may lower a retrieval tool on a wire line. The retrieval tool engages profile 41 in latch sub 39 to secure latch sub 39 to the retrieval string. Since release sleeve 73 has moved down to the lower position of FIG. 7B, an upward pull by the retrieval string on latch sub 39 causes collet lock 57 to buckle radially inward out of locking engagement with the profile in connector sleeve 69. Mandrel 49 moves upward relative to bottom sub 70 until each shoulder 85 contacts shoulder 87. The engagement of shoulders 85 and 87 results in bottom sub 70 and BHA 27 being pulled upward through casing string 16 to the surface. During retrieval, the upward movement of mandrel 49 relative to bottom sub 70 moves seal 81 (FIG. 7B) above apertures 83, allowing the operator to circulate fluid down the inner passage 74 of mandrel 49 and out through apertures 83, if desired.

After retrieval, the operator may rerun BHA 27 with a new drill bit 35 or other component of BHA 27. Alternately, if at total depth, the operator may cement casing string 27 in the well.

The drill lock mechanism 29 of BHA 27 reduces the complexity of prior art drill lock mechanisms. The elastomeric element transfers both torque and axial load. The drill lock mechanism is readily moved between set and retrieval positions.

While only one example of the assembly is shown, it should be apparent to those skilled in the art that it is not so limited, but is susceptible to various changes.

The invention claimed is:

1. An apparatus for drilling a well with a casing string, comprising:

a bottom hole assembly having an upper portion for mounting in the casing string with a lower portion protruding from a lower end of the casing string, the bottom hole assembly having a drilling tool for drilling the well;

a mandrel coupled to the upper portion of the bottom hole assembly;

an elastomeric sleeve encircling the mandrel;

a setting mechanism that moves the sleeve relative to the mandrel from an unset position to a set position in frictional engagement with the casing string and the mandrel to transmit torque and axial load between the bottom hole assembly and the casing string, wherein the setting mechanism has a retainer that selectively holds the sleeve in the set position; and a release device in cooperative engagement with the sleeve and the mandrel that selectively allows the sleeve to move from the set position back to the unset position, wherein the release device operates in response to the landing of a sealing object pumped from a drilling rig down to the release device.

2. The apparatus according to claim 1, wherein the sleeve has a greater thickness and shorter length while in the set position than when in the unset position.

3. The apparatus according to claim 1, wherein the setting mechanism comprises:

a setting ring encircling the mandrel above the sleeve, the setting ring having an upward facing shoulder; and a running tool that releasably secures to the mandrel in engagement with the shoulder on the setting ring and moves the setting ring downward relative to the mandrel to move the sleeve to the set position.

4. The apparatus according to claim 3, wherein the running tool moves the setting ring straight downward without rotation when moving the sleeve to the set position.

5. The apparatus according to claim 4, further comprising a ratchet ring that allows downward movement of the setting ring relative to the mandrel but prevents upward movement of the setting ring.

6. The apparatus according to claim 1, further comprising:

a profile sub that secures into the casing string and has an annular upward facing profile shoulder; and a plurality of spring-biased stop dogs carried by the mandrel, the dogs sliding down the casing string and landing on the profile shoulder to stop further downward movement of the bottom hole assembly.

7. The apparatus accordingly to claim 1, wherein the setting mechanism operates in response to straight downward movement of a setting tool.

8. An apparatus for drilling a well with a casing string, comprising:

a profile sub having an interior profile shoulder, the profile sub securing into and forming part of the casing string;

a bottom hole assembly that is run into and retrievable from the casing string, the bottom hole assembly having an underreamer;

a stop member carried by the bottom hole assembly that lands on the profile shoulder and stops downward movement of the bottom hole assembly, positioning the underreamer below the casing string;

a mandrel coupled to the bottom hole assembly;

an elastomeric sleeve encircling the mandrel;

a setting ring in engagement with an upper end of the sleeve;

a running tool releasably coupled to the mandrel that selectively moves the setting ring downward relative to the mandrel to a lower position to deform the sleeve into frictional engagement with the casing string and the mandrel to transmit torque and axial load between the bottom hole assembly and the casing string;

a retainer cooperatively in engagement with the setting ring and the mandrel to hold the setting ring in the lower position, allowing the running tool to be retrieved;

a release device in cooperative engagement with the mandrel and the setting ring that selectively allows the mandrel and the setting ring to move upward in unison relative to the sleeve while the setting ring is in the lower position to disengage the sleeve from frictional engagement with the casing string and retrieve the bottom hole assembly.

9. The apparatus according to claim 8, wherein the retainer comprises a ratchet ring that moves downward along a set of retainer grooves formed on the mandrel, but does not move upward.

10. The apparatus according to claim 8, wherein the release device operates in response to the landing of a sealing object pumped from a drilling rig down to the release device.

11. A method for drilling a well, comprising:

(a) mounting an elastomeric sleeve to a bottom hole assembly having a drilling tool;

(b) lowering the bottom hole assembly into a casing string suspended in the well;

(c) stopping downward movement of the bottom hole assembly at a selected point with the drilling tool below the casing string and the elastomeric sleeve within the casing string; then (d) deforming the elastomeric sleeve into a setting position in tight frictional engagement with the casing string; and then (e) engaging the bottom of the well with the drilling tool and rotating the casing string, transmitting torque from the rotating casing string through the elastomeric sleeve to the bottom hole assembly and the drilling tool.

12. The method according to claim 11, further comprising:

applying weight from the casing string to the drilling tool by transferring the weight through the elastomeric sleeve to the bottom hole assembly.

13. The method according to claim 11, further comprising:

releasing the elastomeric sleeve from the setting position and retrieving the elastomeric sleeve and the bottom hole assembly through the casing string.

14. The method according to claim 13, wherein releasing the elastomeric sleeve comprises pumping a sealing object down the casing string with a fluid into sealing engagement with a seat provided in the bottom hole assembly, then applying greater fluid pressure to release the elastomeric sleeve.

15. The method according to claim 11, further comprising:

securing a profile sub into the casing string, the profile sub having a landing profile; and step (c) comprises landing a portion of the bottom hole assembly on the landing profile.

* * * * *